US009052638B2

(12) United States Patent
Matsumaru et al.

(10) Patent No.: US 9,052,638 B2
(45) Date of Patent: Jun. 9, 2015

(54) CARTRIDGE AND IMAGE FORMING APPARATUS WITH SEAL MEMBER FOR SEALING A TONER FEEDING OPENING

(71) Applicant: CANON KABUSHIKI KAISHA, Tokyo (JP)

(72) Inventors: Naoki Matsumaru, Numazu (JP); Daisuke Makiguchi, Izunokuni (JP); Yoshiyuki Batori, Suntou-gun (JP); Ryuta Murakami, Suntou-gun (JP); Toshiaki Takeuchi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/039,567

(22) Filed: Sep. 27, 2013

(65) Prior Publication Data

US 2014/0093272 A1 Apr. 3, 2014

(30) Foreign Application Priority Data

Sep. 28, 2012 (JP) ..... 2012-217152

(51) Int. Cl.
*G03G 15/08* (2006.01)

(52) U.S. Cl.
CPC ..... *G03G 15/0881* (2013.01)

(58) Field of Classification Search
CPC ..... G03G 15/0881
USPC ..... 399/106, 105, 103, 102, 119, 120, 258, 399/262, 263
See application file for complete search history.

(56) References Cited

U.S. PATENT DOCUMENTS

| | | | | |
|---|---|---|---|---|
| 5,911,096 | A | 6/1999 | Batori et al. | |
| 5,920,753 | A | 7/1999 | Sasaki et al. | |
| 5,930,562 | A | 7/1999 | Noda et al. | |
| 5,937,237 | A | 8/1999 | Nonaka et al. | |
| 5,940,658 | A | 8/1999 | Yokoi et al. | |
| 6,075,957 | A | 6/2000 | Batori et al. | |
| 6,101,348 | A | 8/2000 | Nonaka et al. | |
| 6,131,007 | A | 10/2000 | Yamaguchi et al. | |
| 6,246,854 | B1 * | 6/2001 | Kurosawa et al. | 399/263 |
| 6,275,668 | B1 | 8/2001 | Batori | |
| 6,334,035 | B1 | 12/2001 | Abe et al. | |
| 6,363,226 | B1 | 3/2002 | Batori | |
| 6,714,746 | B2 | 3/2004 | Morioka et al. | |
| 6,937,832 | B2 | 8/2005 | Sato et al. | |
| 6,963,706 | B2 | 11/2005 | Morioka et al. | |

(Continued)

FOREIGN PATENT DOCUMENTS

| | | | | |
|---|---|---|---|---|
| JP | 03221981 A | * | 9/1991 | G03G 15/08 |
| JP | 5-197288 A | | 8/1993 | |

*Primary Examiner* — Billy Lactaoen
(74) *Attorney, Agent, or Firm* — Fitzpatrick, Cella, Harper & Scinto

(57) ABSTRACT

A cartridge includes: a toner accommodating frame including a toner feeding opening communicating with a toner feeding chamber and a toner filling port; a rotatable member; and a toner seal member. The toner seal member includes a first fixed portion and a second fixed portion which are fixed on the toner accommodating frame at an edge of the toner feeding opening along a longitudinal direction of the toner feeding opening, and includes a third fixed portion fixed on the rotatable member. With rotation of the rotatable member, the first fixed portion of the toner seal member is peeled off from a fixing portion to open the toner feeding opening. The toner is filled into said toner accommodating frame through the toner filling port such that the toner is first filled into a recess defined by said toner seal member.

16 Claims, 10 Drawing Sheets

(56) References Cited

U.S. PATENT DOCUMENTS

| | | | |
|---|---|---|---|
| 7,062,195 | B2 | 6/2006 | Kurihara et al. |
| 7,079,787 | B2 | 7/2006 | Ogino et al. |
| 7,127,192 | B2 | 10/2006 | Batori et al. |
| 7,136,604 | B2 | 11/2006 | Chadani et al. |
| 7,200,349 | B2 | 4/2007 | Sato et al. |
| 7,203,442 | B2 | 4/2007 | Matsubara et al. |
| 7,418,225 | B2 | 8/2008 | Morioka et al. |
| 7,885,575 | B2 | 2/2011 | Batori et al. |
| 8,081,898 | B2 | 12/2011 | Batori et al. |
| 8,238,784 | B2 | 8/2012 | Kusudo et al. |
| 8,311,449 | B2 | 11/2012 | Kusudo et al. |
| 8,326,185 | B2 | 12/2012 | Asanuma et al. |
| 8,406,656 | B2 | 3/2013 | Batori et al. |
| 8,565,640 | B2 | 10/2013 | Batori et al. |
| 8,644,732 | B2 | 2/2014 | Kikuchi et al. |
| 2007/0280739 | A1* | 12/2007 | Tanaka ..... 399/254 |

* cited by examiner (a)

(b)

CARTRIDGE AND IMAGE FORMING APPARATUS WITH SEAL MEMBER FOR SEALING A TONER FEEDING OPENING

FIELD OF THE INVENTION AND RELATED ART

The present invention relates to an image forming apparatus such as a copying machine, a printer or a facsimile machine, and relates to a cartridge for use with the image forming apparatus.

In a conventional cartridge used in the image forming apparatus, a constitution in which a toner seal member is fixed at a toner feeding opening for permitting communication between a toner accommodating portion of a toner accommodating frame and a toner feeding chamber, and then is unsealed by rotation of a rotatable member has been proposed (Japanese Laid-Open Patent Application (JP-A) Hei 5-197288).

As a result, it is possible to prevent toner leakage which can be caused by vibration or impact during transportation of the cartridge. Further, there is no need for a user to unseal the toner seal member, and therefore usability is improved.

SUMMARY OF THE INVENTION

The present invention is a further development of the conventional cartridge, and a principal object of the present invention is to suppress peeling-off of a toner seal member from a toner feeding opening by power pressure of a toner when the toner is filled into a toner accommodating frame.

According to an aspect of the present invention, there is provided a cartridge comprising: a toner accommodating frame for accommodating a toner, wherein the toner accommodating frame includes a toner feeding opening communicating with a toner feeding chamber and a toner filling port for permitting filling of the toner; a rotatable member rotatably supported in the toner accommodating frame; and a toner seal member for sealing the toner feeding opening, wherein the toner seal member includes a first fixed portion and a second fixed portion which are fixed on the toner accommodating frame at an edge of the toner feeding opening along a longitudinal direction of the toner feeding opening, includes a third fixed portion fixed on the rotatable member, wherein with rotation of the rotatable member, the first fixed portion of the toner seal member is peeled off from a fixing portion to open the toner feeding opening, and wherein the toner is filled into said toner accommodating frame through the toner filling port such that the toner is first filled into a recess defined by said toner seal member.

According to another aspect of the present invention, there is provided an image forming apparatus comprising the cartridge detachably mountable to the image forming apparatus.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (a) to (c) of FIG. 1 are schematic views for illustrating toner filling into a toner accommodating frame in First Embodiment.

Figure 6:
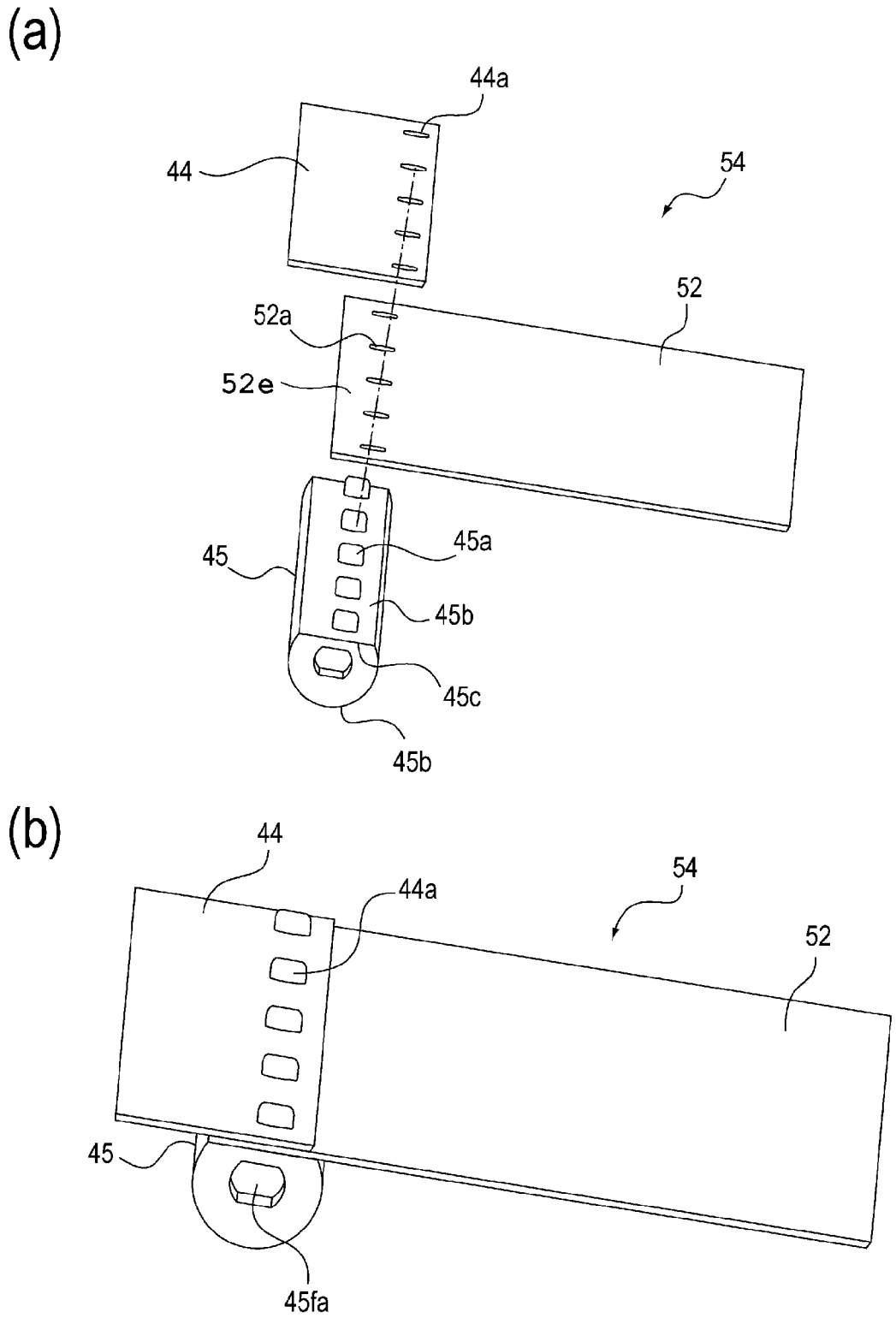

Part (a) of FIG. 6 is an exploded perspective view of a rotatable member unit, and (b) of FIG. 6 is a perspective view of the rotatable member unit.

Figure 7:
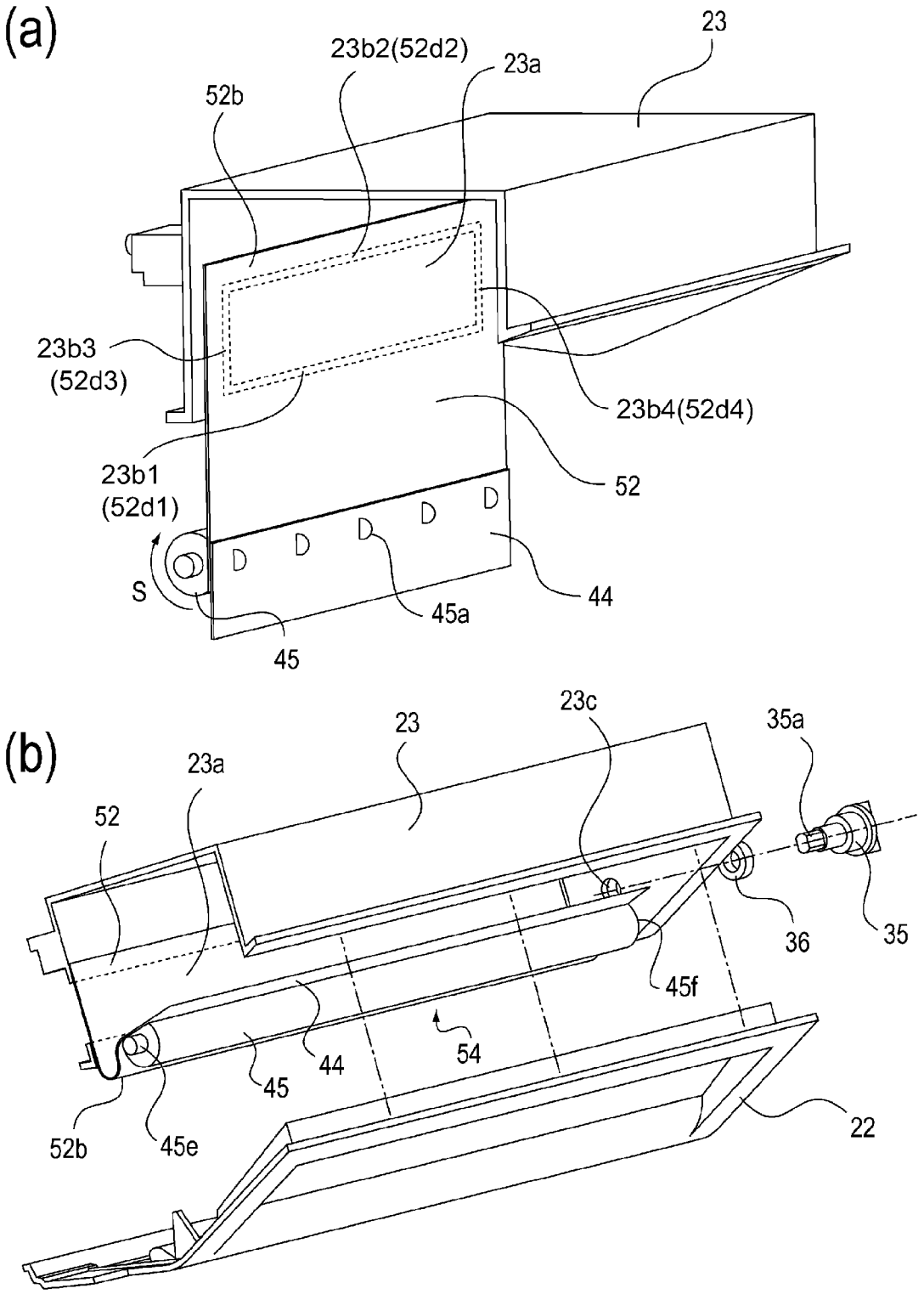

Parts (a) and (b) of FIG. 7 are perspective views for illustrating a mounting method of the rotatable member unit onto a toner accommodating frame.

Figure 8:
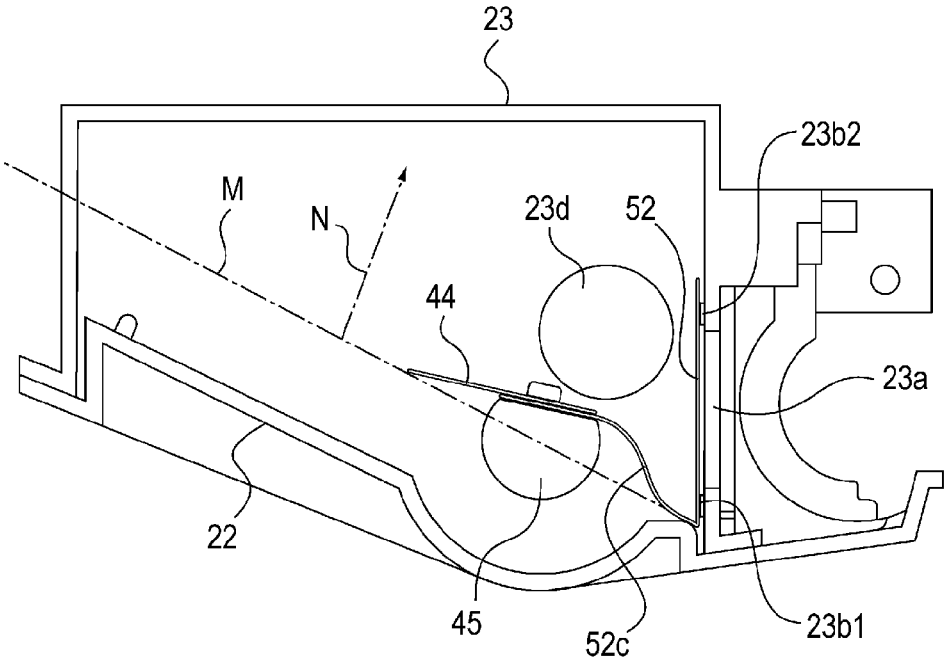
Figure 8:
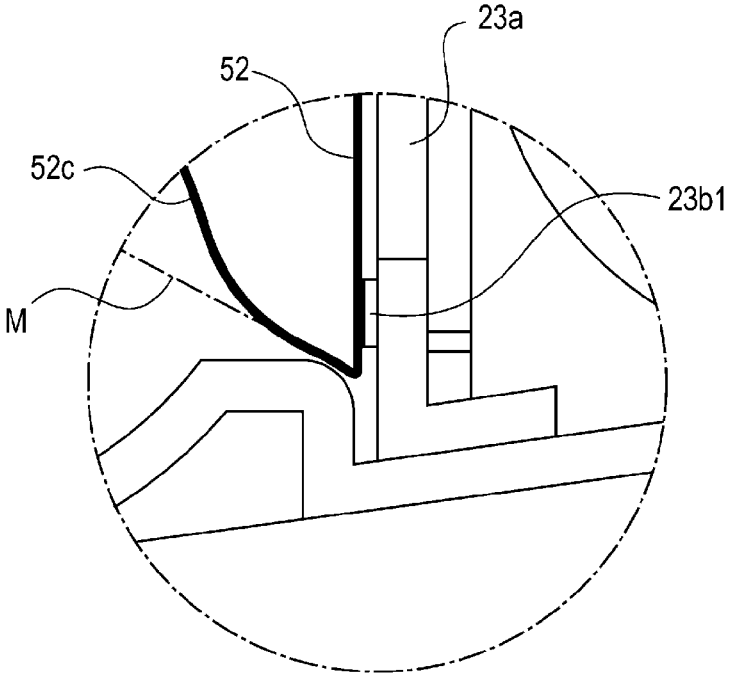

Part (a) of FIG. 8 is a sectional view of a developing device unit before a toner is filled, and (b) of FIG. 8 is a partly enlarged view of a toner seal member in the neighborhood of a first fixed portion.

Figure 9:
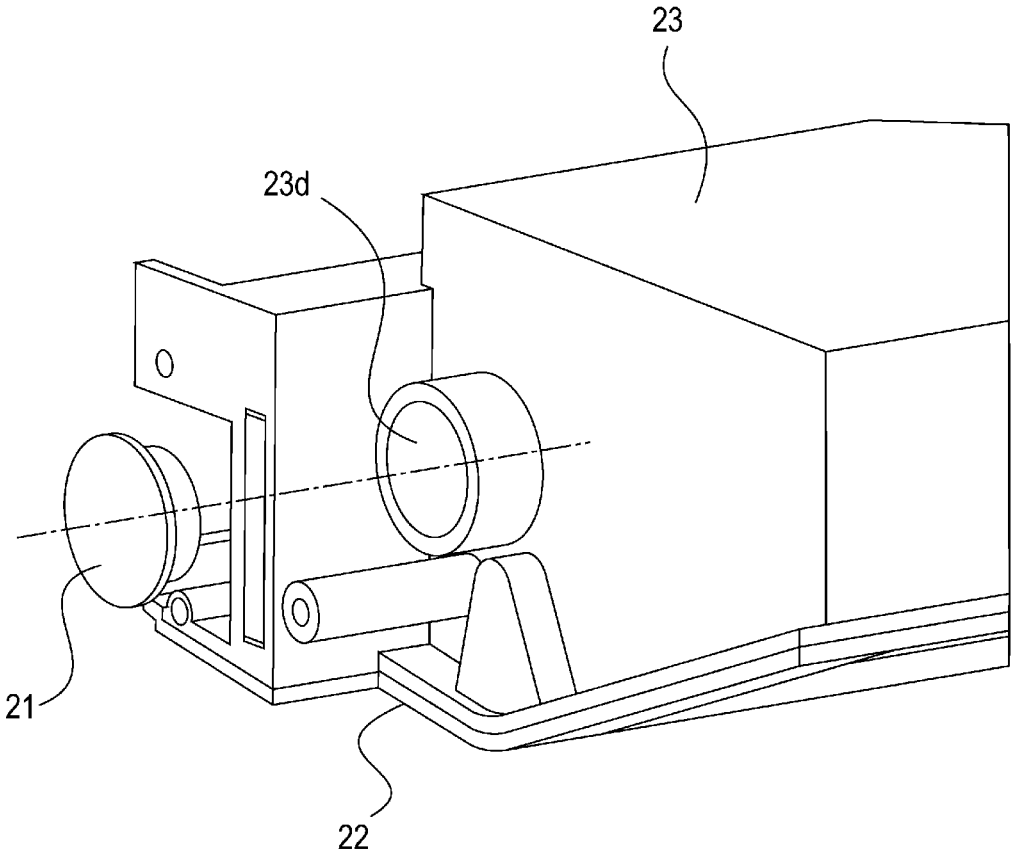

FIG. 9 is a perspective view for illustrating the toner filling in First Embodiment.

Figure 10:
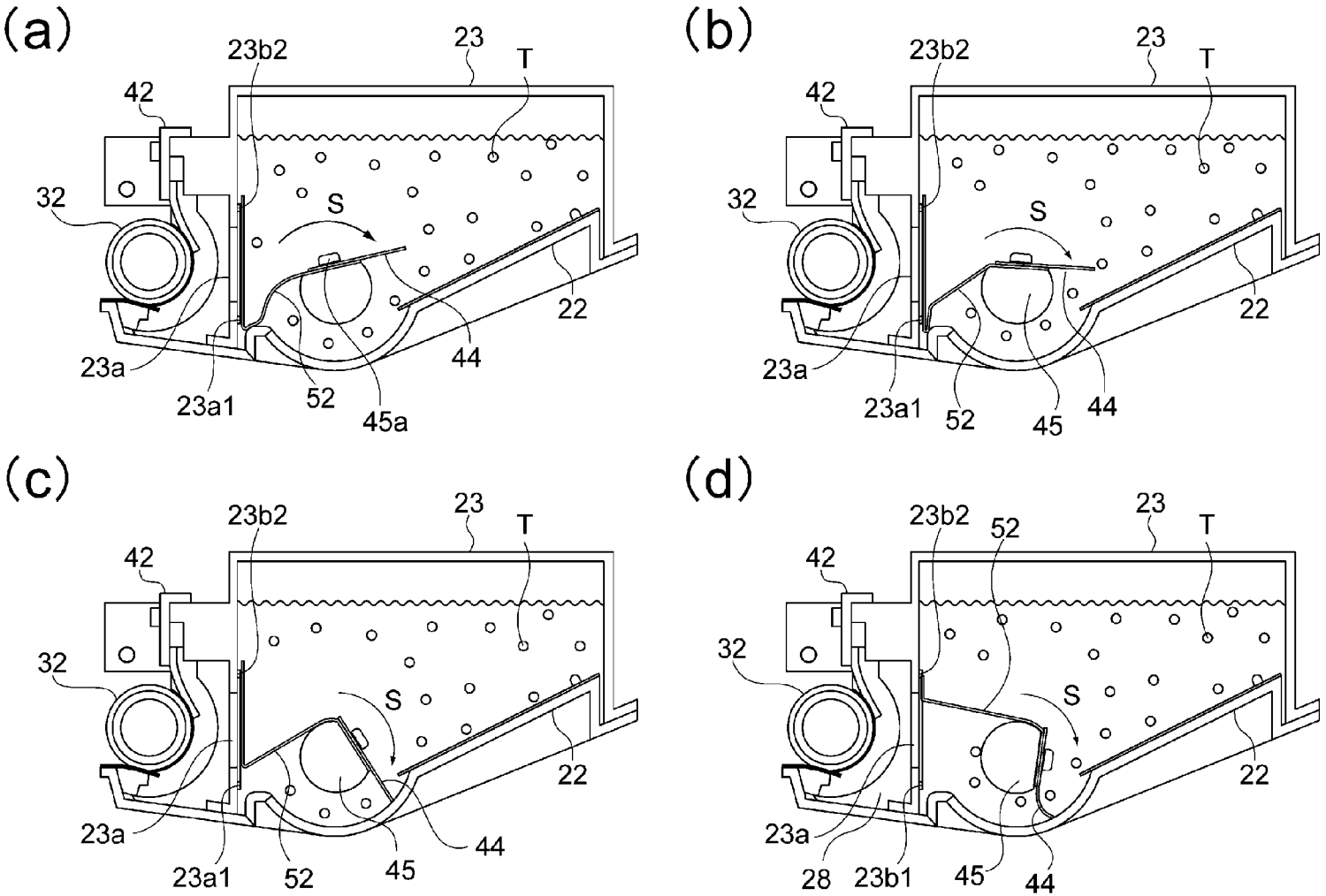

Parts (a) to (d) of FIG. 10 are sectional views for illustrating an unsealing operation of the toner seal member performed during start of use of a process cartridge.

Figure 11:
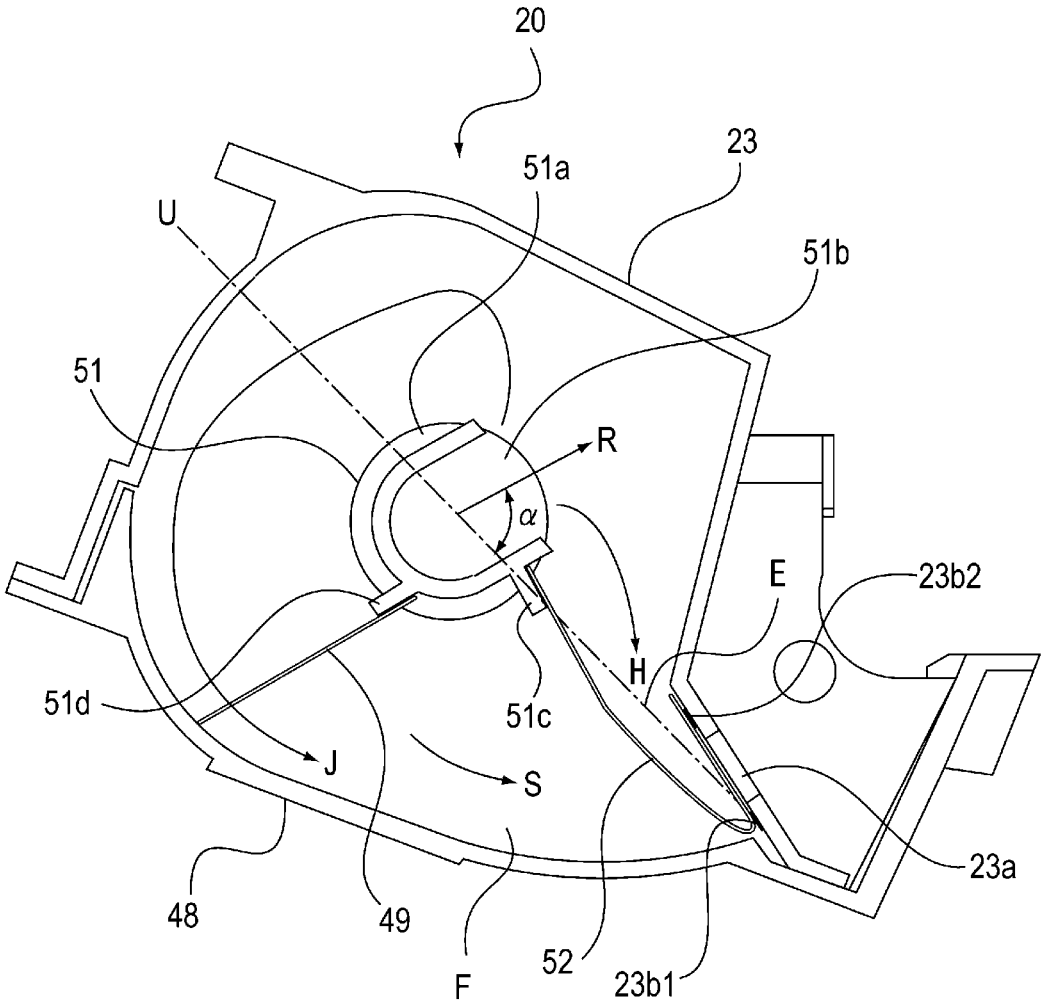

FIG. 11 is a sectional view of a developing device unit in Second Embodiment.

Figure 12:
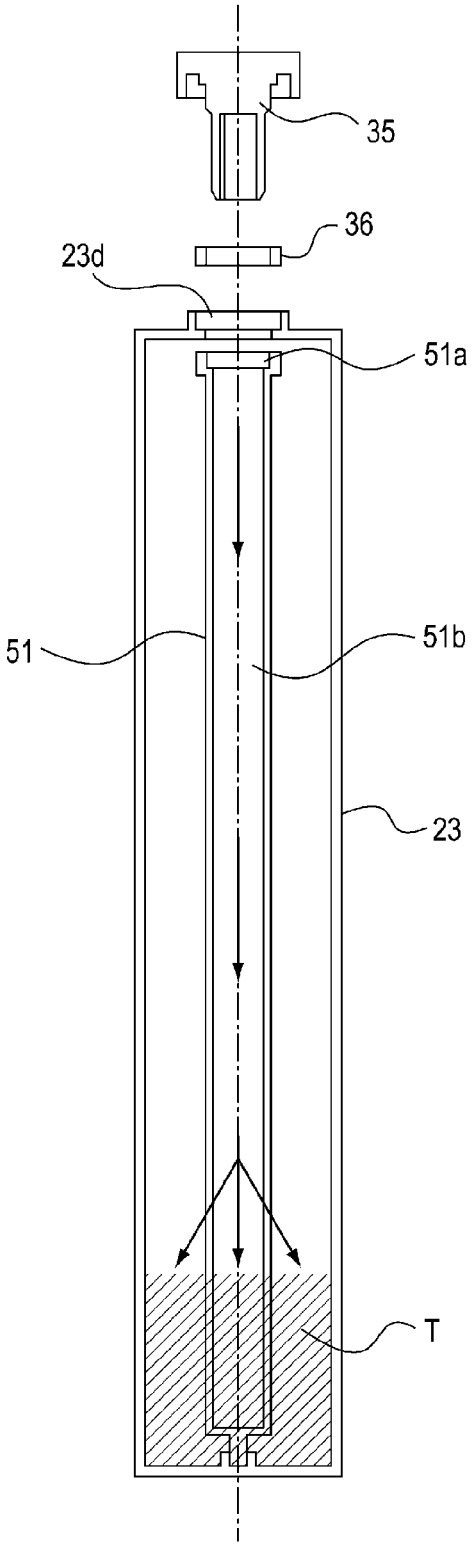

FIG. 12 is a schematic view for illustrating a method in which a toner is filled into a toner accommodating frame in the developing device unit in Second Embodiment.

DESCRIPTION OF THE PREFERRED EMBODIMENTS

First Embodiment

Figure 2:
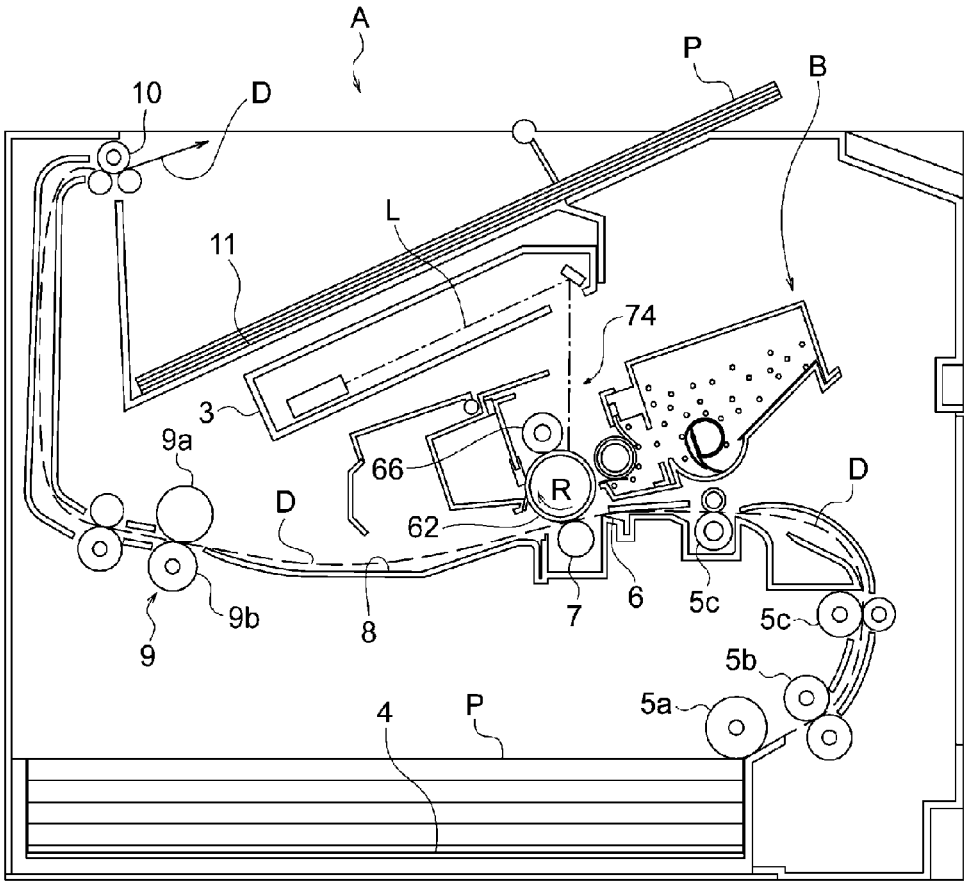
FIG. 2 is an illustration of an image forming apparatus in First Embodiment.
Figure 3:
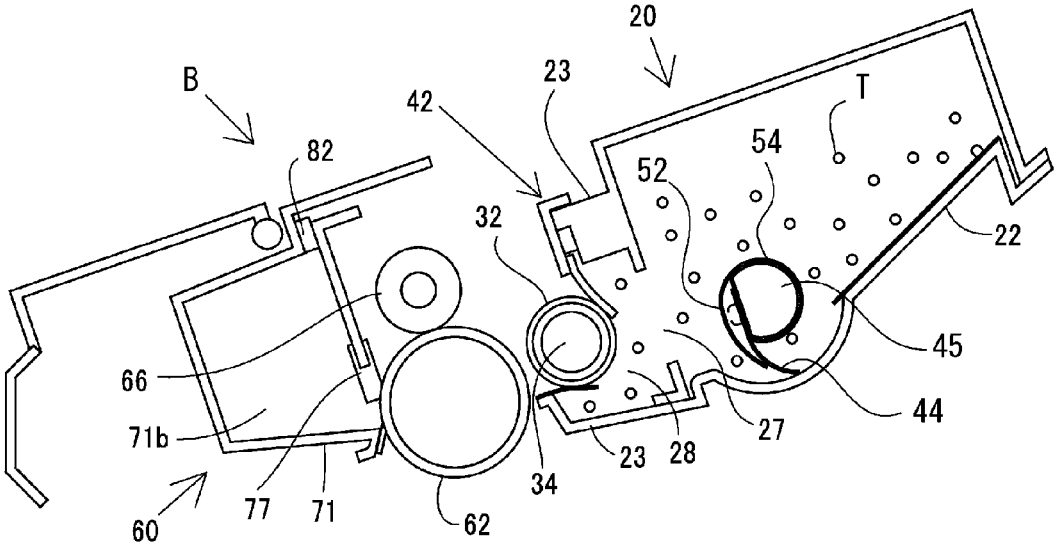
FIG. 3 is an illustration of a cartridge in First Embodiment.

A cartridge and an image forming apparatus according to the present invention in First Embodiment will be described with reference to the drawings. FIG. 2 is an illustration of the image forming apparatus according to the present invention in this embodiment. FIG. 3 is an illustration of a process cartridge B in this embodiment.

As shown in FIG. 2, the image forming apparatus in this embodiment includes the process cartridge B detachably mountable to an image forming apparatus main assembly A. In the image forming apparatus in this embodiment, a photosensitive drum (image bearing member) 62 electrically charged by a charging roller 66 is exposed to laser light L, depending on image information by an exposure device 3, so that an electrostatic latent image is formed.

Further, as shown in FIG. 3, in a developing device unit (developing device) 20 of the cartridge B, a toner T in a toner chamber 27 in a toner accommodating frame 23 is stirred and fed by a toner feeding sheet 44, so that the toner T is carried by a magnetic force of a magnet roller 34 on a surface of a developing roller 32. The toner carried on the developing roller 32 is regulated in layer thickness by a developing blade 42 while being triboelectrically charged, and then is transferred onto the photosensitive drum 62 depending on the electrostatic latent image, so that the electrostatic latent image is visualized as a toner image.

Figure 1:
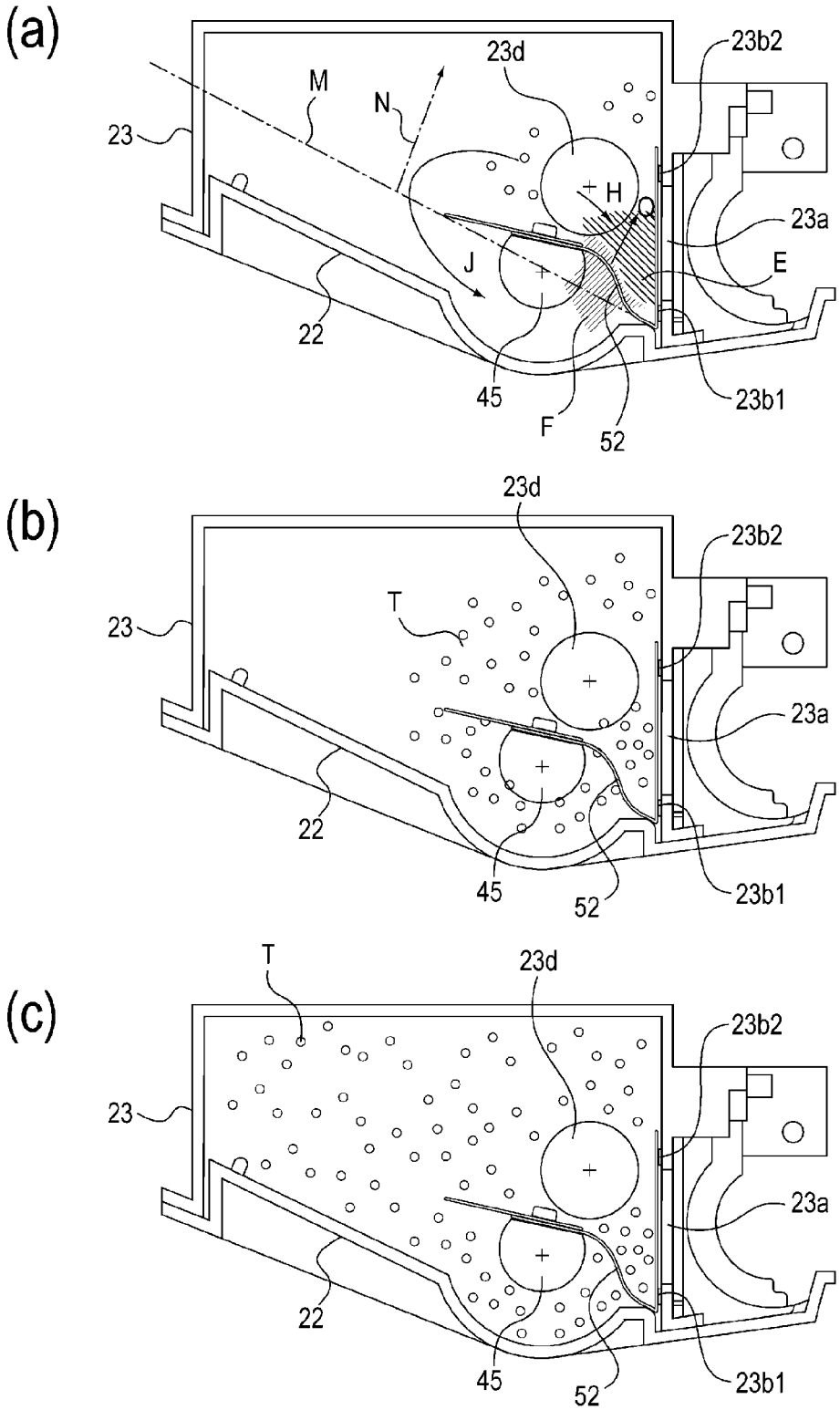

On the other hand, as shown in FIG. 1, by a pick-up roller 5*a*, a feeding roller pair 5*b* and a conveying roller pair 5*c*, a sheet P accommodated in a sheet tray 4 is conveyed to a nip (transfer portion) between the photosensitive drum 62 and a transfer roller 7 via a transfer guide 6, so that the toner image is successively transferred onto the sheet P. The sheet P on which the toner image is transferred is conveyed to a fixing device 9 along a conveying guide 8, and then is pressed and heated at a nip between a heating roller 9*a* and a pressing roller 9*b* which constitute the fixing device 9, so that the toner image is fixed on the sheet P. The sheet P on which the toner image is fixed is discharged onto a discharge tray 11 by a discharging roller pair 10.

As shown in FIG. 3, a transfer residual toner remaining on the photosensitive drum 62 after the toner image transfer is removed by a cleaning blade 77, and is stored in a residual toner chamber 71*b* of a cleaning unit 60.

(Mounting and Demounting Structure of Cartridge B)

Figure 4:
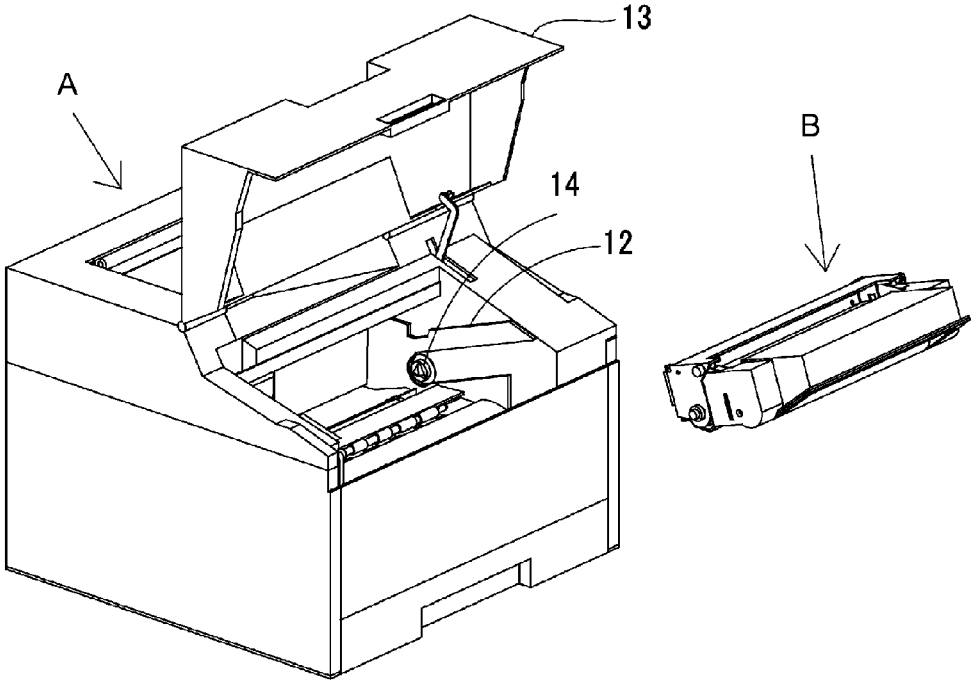
FIG. 4 is a perspective view for illustrating mounting and demounting of the cartridge with respect to an image forming apparatus main assembly in First Embodiment.

FIG. 4 is a perspective view of the cartridge B and the image forming apparatus main assembly A from which an openable door 13 is opened for permitting mounting and demounting of the cartridge B. As shown in FIG. 4, the apparatus main assembly A openably includes the openable door 13. In a state in which the openable door 13 is opened, the cartridge B can be mounted into and demounted from the image forming apparatus main assembly A along a guide rail 12.

When the cartridge B is mounted, a driving shaft 14 to be driven by a motor (not shown) of the apparatus main assembly A is engaged with a driving force receiving portion provided on the cartridge B. As a result, the photosensitive drum 62 connected with the driving force receiving portion is rotated by receiving a driving force from the apparatus main assembly A.

(General Structure of Cartridge B)

Figure 5:
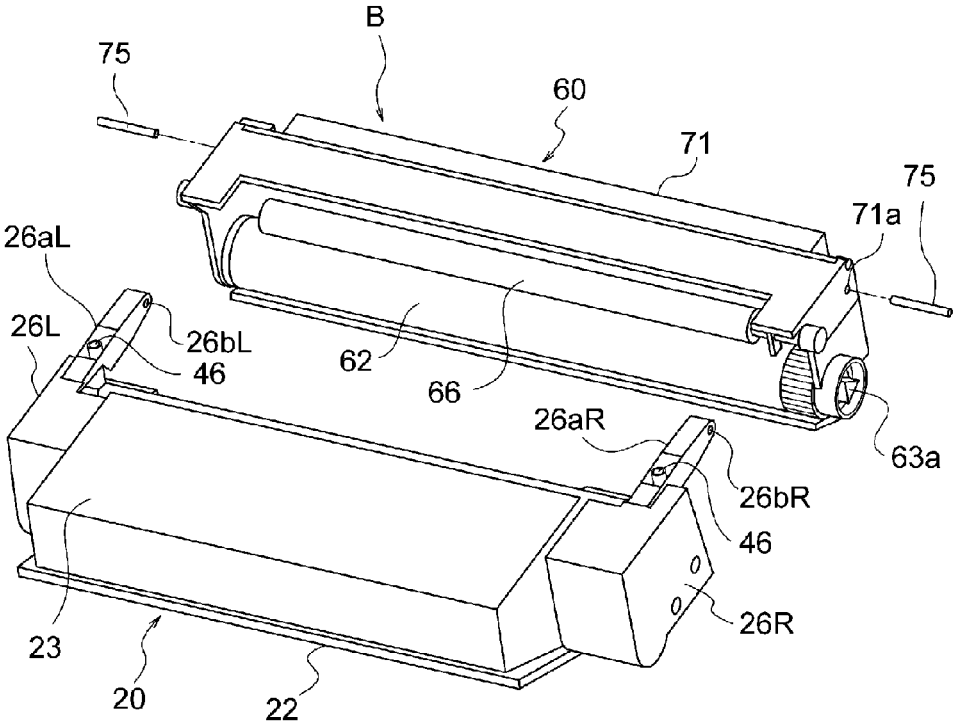
FIG. 5 is a perspective view of the cartridge in First Embodiment.

FIG. 5 is a perspective view of the cartridge B. As shown in FIG. 5, the cartridge B includes the cleaning unit 60 and the developing device unit 20.

The cleaning unit 60 includes a cleaning frame 71, the photosensitive drum 62, the charging roller 66 and the cleaning blade 77.

The developing device unit 20 includes a cap 22, a toner accommodating frame 23, first and second side members 26L and 26R, a developing blade 42, the developing roller 32, the magnet roller 34, the toner feeding sheet 44, an urging member 46, and a rotatable member unit (toner filling means) 54.

The cartridge B connects the cleaning unit 60 and the developing device unit 20 rotationally movably with each other by a connecting member 75. Specifically, at each of longitudinal end portions of the cleaning frame 71, an engaging hole 71*a* for permitting engagement therein of the connecting member 75 is formed.

At end portions of arm portions 26*a*L and 26*a*R formed on the first and second side members 26L and 26R, respectively, located at the longitudinal end portions of the developing device unit 20, rotational movement holes 26*b*L and 26*b*R which are parallel to the driving roller 32 are provided, respectively.

Then, the arm portions 26*a*L and 26*a*R are aligned with predetermined positions of the cleaning frame 71, and then the connecting members 75 are inserted into the rotational movement holes 26*b*L and 26*b*R and the engaging holes 71*a*, so that the cleaning unit 60 and the developing device unit 20 are connected with each other rotatably about the connecting members 75.

At this time, urging members 46 mounted at base portions of the arm portions 26*a*L and 26*a*R abut against the cleaning frame 71, so that the urging members 46 urge the developing device unit 20 toward the cleaning unit 60 with the connecting members 75 as the rotation centers. As a result, the developing roller 32 is pressed toward the photosensitive drum 62 with reliability.

(Developing Device Unit 20)

As shown in FIG. 3, the developing device unit 20 includes the rotatable member unit 54. The rotatable member unit 54 includes the toner feeding sheet 44, a rotatable member 45 and a toner seal member 52.

Part (a) of FIG. 6 is an exploded perspective view of the rotatable member unit 54 in this embodiment, and (b) of FIG. 6 is a perspective view of the rotatable member unit 54.

As shown in (a) of FIG. 6, the toner feeding sheet 44 has a sheet shape shorter than the toner seal member 52, and is provided with a plurality of holes 44*a*, disposed along a longitudinal direction of the developing device unit 20, in a side of the toner feeding sheet 44. The toner feeding sheet 44 is constituted by a material, having flexibility, such as PET, PC or PPS.

The toner seal member 52 has a rectangular sheet shape, and is provided with a plurality of holes 52*a*, disposed along the longitudinal direction of the developing device unit 20, in a side (second end portion) of the toner seal member 52. The toner seal member 52 is constituted by a material which has compatibility with a material for the toner accommodating frame 23 or which has an adhesive layer.

The rotatable member 45 has a shape such that a cylinder is cut along a chord 45*c* and a mounting surface 45*d* perpendicular to the chord 45*c*. A cross section of the rotatable member 45 as seen in a longitudinal direction of the developing device unit 20 includes an arcuate portion 45*b* and the chord 45*c*. On the mounting surface 45*d*, a third fixed portion (portion-to-be-fixed) 52*e* of the toner seal member 52 is mounted.

As shown in (b) of FIG. 6, the mounting surface 45*d* is provided with a plurality of projections 45*a*. The plurality of projections 45*a* supports the respective holes 52*a* and 44*a* in a state in which the toner seal member 52 and the toner feeding sheet 44 are superposed. In this state, the toner seal member 52 and the toner feeding sheet 44 are thermally caulked, so that the toner seal member 52 and the toner feeding sheet 44 are fixed on the rotatable member.

Incidentally, the fixing of the toner seal member 52 and the toner feeding sheet 44 on the rotatable member 44 is not limited to the thermal caulking but may also be performed by using a double-side tape, snap-fitting or the like. Further, the mounting surface of the toner seal member 52 and the toner feeding sheet 44 may also be different surfaces, of the rotatable member 45, on which the toner seal member 52 and the toner feeding sheet 44 are separately mounted.

Parts (a) and (b) of FIG. 7 are perspective views for illustrating a mounting method of the rotatable member unit 54 on the toner accommodating frame 23. As shown in (a) of FIG. 7, the toner seal member 52 is fixed at an end portion 52*b* (first end portion), opposite from the holes 52*a*, on a fixing portion 23*b* around a toner feeding opening 23*a* of the toner accommodating frame 23 by thermal welding or the like. By the toner feeding opening 23*a*, an inside of the toner accommodating frame 23 and the toner feeding chamber 28 communicate with each other.

The fixing portion 23*b* is constituted by a first fixing portion 23*b*1 and a second fixing portion 23*b*2 which extends along a longitudinal direction of the rectangular toner feeding opening 23, and a third fixing portion 23*b*3 and a fourth fixing portion 24*b*4 which extends along a widthwise (short) direction of the toner feeding opening 23. The first to fourth fixing portions 23*b*1 to 23*b*4 are continuously formed, and therefore it becomes possible to seal (confine) the toner. The first fixing portion 23*b*1 is located closer to the rotatable member 45 than the second fixing portion 23*b*2. The third fixing portion 23*b*3 is located in the non-driving side. The fourth fixing portion 23*b*4 is located in the driving side.

The toner seal member 52 includes a fixed portion (portion-to-be-fixed) 52*d* to be fixed on the fixing portion 23*b*. The fixed portion 52*d* includes first to fourth fixed portions 52*d*1 to 52$d$4 to be fixed in positions corresponding to positions of the first to fourth fixing portions 23$d$1 to 23$d$4.

As shown in (b) of FIG. 7, in a state in which the toner seal member 52 seals the toner feeding opening 23$a$, the rotatable member unit 54 is supported at a hole 45$fa$ ((b) of FIG. 6) provided at a driving-side end portion 45$f$ by a shaft portion 35$a$ of a stirring gear 35 via a seal ring 36 and a hole 23$c$ of the toner accommodating frame 23. The seal ring 36 prevents toner leakage from the hole 23$c$ of the toner accommodating frame 23. On the other hand, a shaft portion 45$e$ located at a non-driving-side end portion of the rotatable member 45 is rotatably supported in a hole (not shown) of the toner accommodating frame 23. After the rotatable member unit 54 is supported by the toner accommodating frame 23, the cap 22 is fixed on the toner accommodating frame 23 by welding or the like.

Part (a) of FIG. 8 is a sectional view of the developing device unit 20 before the toner is filled, and (b) of FIG. 8 is an enlarged view of the toner seal member 52 of (a) of FIG. 8 in the neighborhood of the first fixing portion 23$b$1.

As shown in (a) of FIG. 8, a center of the toner filling port 23$d$ is disposed toward the toner feeding opening 23$a$ (toward N direction in (a) of FIG. 8) than a line M connecting the first fixing portion 23$b$1 and a rotation center of the rotatable member 45. Further, the center of the toner filling port 23$d$ is disposed toward the fixing portion 23$b$ than the center of the rotatable member 45. That is, the toner filling port 23$d$ is disposed upstream of the toner seal member 52 with respect to a vertical direction and is disposed toward the fixing portion 23$b$ (toward the toner feeding opening) than the rotatable member 45 with respect to a horizontal direction.

Parts (a) to (c) of FIG. 1 are sectional views for illustrating filling of the toner into the toner accommodating frame 23 in this embodiment. As shown in (a) of FIG. 1, the toner filling port 23$d$ is disposed in the above-described position, and therefore the toner flowing out from the toner filling port 23$d$ in H direction is first filled into a region E (recess constituted by the toner seal member 52) between the toner seal member 52 and the fixing portion 23$b$ in the toner accommodating frame 23. As shown in (b) of FIG. 1, when the region E is fully filled with the toner, the toner flows out from the toner filling port 23$d$ in J direction, so that the toner is filled into a region F located at a lower portion of the rotatable member 45. As shown in (b) and (c) of FIG. 1, with the filling of the toner into the regions E and F, the toner extends over an entire region of the inside of the toner accommodating frame 23, so that the filling of the toner is completed.

As a result, a force due to powder pressure when the toner is filled into the region F can be alleviated by the weight of the toner in the region E, so that a force in a direction (arrow Q direction in (a) of FIG. 1) of peeling the toner seal member 52 from the first fixing portion 23$b$1 by the toner in the region F can be alleviated. As a result, it is possible to suppress the peeling of the toner seal member 52 from the toner feeding opening 23$a$ during the filling of the toner.

As shown in FIG. 9, the toner filling port 23$d$ is provided on a non-driving-side end surface of the toner accommodating frame 23. The toner filling port 23$d$ is, when the filling of the toner is completed, sealed by press-fitting a cap 21 into the toner filling port 23$d$.

Parts (a) to (d) of FIG. 10 are sectional views for illustrating an unsealing operation of the toner seal member 52 to be performed during start of use of the process cartridge B. As shown in (a) of FIG. 10, the process cartridge B is mounted in the apparatus main assembly A, and in a state before the driving force is transmitted to the process cartridge B, a loosened portion 52$c$ of the toner seal member 52 is formed between the first fixing portion 23$b$1 and the projection 45$a$. As a result, even when the force acts on the rotatable member 45 during transportation of the process cartridge B, no tension is exerted on the toner seal member 52, so that a toner sealing property can be maintained.

As shown in (b) and (c) of FIG. 10, when the driving force is transmitted from the apparatus main assembly A to the process cartridge B, the rotatable member 45 is rotated in S direction in FIG. 10. As a result, as shown in (d) of FIG. 10, the toner seal member 52 is pulled in W direction in (a) of FIG. 10, and then the second fixed portion 52$d$2 is peeled off from the fixing portion 23$d$ to be wound up around the rotatable member 45, so that the toner feeding opening 23$a$ is unsealed. Then, the toner in the toner accommodating frame 23 is fed to the toner feeding chamber 28 by the toner feeding sheet 44 through the opened toner feeding opening 23$a$.

In this way, during the start of use of the toner feeding opening 23$a$, the rotatable member unit 54 is located below a powder surface of the toner with respect to a direction of gravitation, and the toner feeding sheet 44 is located in a contactable position with an inner wall of the toner chamber 27.

Further, even when the second fixed portion 52$d$2 is not peeled off from the fixing portion 23$b$, a constitution in which when breaks (slits) are provided between the first fixed portion 52$d$1 and the second fixed portion 52$d$2, the breaks are broken by a force of winding the toner seal member 52 around the rotatable member 45 to unseal the toner feeding opening 23$a$ may also be employed. In this case, the second fixed portion 52$d$2 is left in a state in which the second fixed portion 52$d$2 is fixed on the fixing portion 23$b$ of the toner accommodating frame 23.

Second Embodiment

Second Embodiment of the cartridge and the image forming apparatus according to the present invention will be described with reference to the drawings. Portions for which redundancy in description is made with respect to First Embodiment will be omitted from description. FIG. 11 is a sectional view of a developing device unit 20 in this embodiment. In FIG. 11, a developing blade, a developing roller 32 and the like are omitted. FIG. 12 is a schematic view for illustrating a method of filling the toner into a toner accommodating frame 47 in the developing device unit 20 in this embodiment. In FIG. 12, a toner seal member for sealing a toner feeding opening 47$a$ and a toner feeding sheet 49 (FIG. 11) for filling the toner are omitted.

As shown in FIG. 11, in the cartridge in this embodiment, the rotatable member 45 in First Embodiment is changed to a rotatable member 51. The rotatable member 51 is formed in a U-character shape and includes rib-shaped fixing surfaces 51$c$ and 51$d$. On the fixing surface 51$c$, a fixed portion 52$e$ of a toner seal member 52 is fixed. On the fixing surface 51$d$, a toner feeding sheet 44 is fixed. A fixing method may be, similarly as in First Embodiment, the thermal caulking, the snap-fitting, the double-side tape or the like.

As shown in FIG. 12, at a longitudinal end portion of a toner accommodating frame 23, a toner filling port 23$d$ for permitting filling of the toner into the toner accommodating frame 23 is provided. Further, at a longitudinal end portion of the rotatable member 51, a toner receiving port 51$a$ connected with the toner filling port 23$d$ is provided. The rotatable member 51 is provided with an opening 51$b$ which is a U-shaped groove extending in a longitudinal thereof. The toner receiving port 51$a$ and the opening 51$b$ are continuously formed. The toner from the toner filling port 23$d$ is received through the toner receiving port 51*a*, and then the received toner is extended over the inside of the toner accommodating frame 47 through the opening 51*b*.

As shown in FIG. 11, during toner filling, an angle α formed between an open direction R of the opening 51*b* provided in the rotatable member 51 and a line U connecting a first fixing portion 23*b*1 and the fixing surface 51*c* is constituted so as to be 180 degrees or less, preferably be 90 degrees or less. As a result, the toner introduced from the toner receiving port 51*a* is filled into a region E by a flow in arrow H direction in FIG. 11, and thereafter is filled into a region F by a flow in arrow J direction in FIG. 11.

As a result, similarly as in First Embodiment, a force due to powder pressure when the toner is filled into the region F can be alleviated by the weight of the toner in the region E, so that a force in a direction of peeling the toner seal member 52 from the first fixing portion 23*b*1 by the toner in the region F can be alleviated. As a result, it is possible to suppress the peeling of the toner seal member 52 from the toner feeding opening 23*a* during the filling of the toner.

After the toner is filled in the toner accommodating frame 47, as shown in FIG. 12, the toner feeding opening 23*d* is sealed by a stirring gear 35 via a seal ring 35.

According to the present invention, when the toner is filled into the toner accommodating frame, powder pressure of the toner exerted on the fixed portion where the toner seal member is fixed on the toner feeding opening can be suppressed. As a result, it is possible to suppress the peeling-off of the toner seal member from the toner feeding opening.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 217152/2012 filed Sep. 28, 2012, which is hereby incorporated by reference.

What is claimed is:

1. A cartridge comprising:

a toner accommodating frame for accommodating toner, wherein said toner accommodating frame includes (i) a toner feeding opening communicating with a toner feeding chamber and (ii) a side wall that has a toner filling port for permitting filling of the toner;

a rotatable member rotatably supported in said toner accommodating frame; and a toner seal member for sealing said toner feeding opening, wherein said toner seal member includes a first fixed portion and a second fixed portion that are fixed on said toner accommodating frame at an edge of said toner feeding opening along a longitudinal direction of said toner feeding opening, and said toner seal member includes a third fixed portion fixed on said rotatable member, wherein, with rotation of said rotatable member, said first fixed portion of said toner seal member is peeled off from a fixing portion to open said toner feeding opening, and wherein the toner is filled into said toner accommodating frame through said toner filling port such that the toner is first filled into a recess defined by said toner seal member.

2. A cartridge according to claim 1, wherein said toner filling port is sealed.

3. A cartridge according to claim 1, wherein in a cross section as seen in a longitudinal direction of said cartridge, a center of said toner filling port is located upstream of said toner seal member with respect to a vertical direction and is located more toward said toner feeding opening than said rotatable member with respect to a horizontal direction.

4. A cartridge according to claim 1, wherein said rotatable member is provided with an opening for receiving the toner from said toner feeding opening and for guiding the received toner into said toner accommodating frame, and wherein, in a cross section as seen in a longitudinal direction of said cartridge, an angle formed between an opening direction of said opening and a line connecting said first fixed portion and said third fixed portion is 180 degrees or less.

5. A cartridge according to claim 4, wherein the angle formed between the opening direction of said opening and the line connecting said first fixed portion and said third fixed portion is 90 degrees or less.

6. A cartridge according to claim 4, wherein said opening is a U shaped groove.

7. A cartridge according to claim 4, wherein said rotatable member is provided with a toner receiving port to be connected with said toner filling port at a longitudinal end portion thereof.

8. A cartridge according to claim 7, wherein said toner receiving port and said opening are continuously formed.

9. A process cartridge comprising:

an image bearing member; and a cartridge according to claim 1.

10. An image forming apparatus comprising:

a cartridge according to claim 1 detachably mountable to said image forming apparatus.

11. A cartridge comprising:

a toner accommodating frame including (i) a toner feeding opening communicating with a toner feeding chamber and (ii) a side wall that has a toner filling port for permitting filling of the toner;

a rotatable member rotatably supported in said toner accommodating frame; and a toner seal member for sealing said toner feeding opening, wherein, with rotation of said rotatable member, said toner seal member is peeled off to open said toner feeding opening, and wherein the toner is filled into said toner accommodating frame through said toner filling port such that the toner is first filled into a recess defined by said toner seal member.

12. A cartridge according to claim 1, wherein a rotation center of said rotatable member is below said toner filling port.

13. A cartridge according to claim 1, wherein a rotation center of said rotatable member is below a center position of said toner filling port.

14. A cartridge according to claim 1, further comprising a toner feeding sheet.

15. A cartridge according to claim 14, wherein said toner feeding sheet feeds the toner while contacting said toner accommodating frame.

16. A cartridge according to claim 1, wherein said toner filling port is above said recess.

* * * * *